US010525721B2

(12) United States Patent
Mu et al.

(10) Patent No.: US 10,525,721 B2
(45) Date of Patent: Jan. 7, 2020

(54) DROP EJECTION USING IMMISCIBLE WORKING FLUID AND INK

(71) Applicant: RF Printing Technologies LLC, Pittsford, NY (US)

(72) Inventors: Richard Mu, Irvine, CA (US); Yonglin Xie, Rochester, NY (US)

(73) Assignee: RF PRINTING TECHNOLOGIES, Pittsford, NY (US)

( * ) Notice: Subject to any disclaimer, the term of this patent is extended or adjusted under 35 U.S.C. 154(b) by 0 days.

(21) Appl. No.: 16/180,211

(22) Filed: Nov. 5, 2018

(65) Prior Publication Data

US 2019/0100023 A1 Apr. 4, 2019

Related U.S. Application Data

(62) Division of application No. 15/436,888, filed on Feb. 20, 2017, now Pat. No. 10,155,384.

(51) Int. Cl.
*B41J 2/175* (2006.01)
*B41J 2/14* (2006.01)

(52) U.S. Cl.
CPC ..... *B41J 2/17596* (2013.01); *B41J 2/1404* (2013.01); *B41J 2002/14483* (2013.01)

(58) Field of Classification Search
CPC ..... B41J 2/17596; B41J 2/1404; B41J 2002/14483
See application file for complete search history.

(56) References Cited

U.S. PATENT DOCUMENTS

| | | | |
|---|---|---|---|
| 4,480,259 | A | 10/1984 | Kruger et al. |
| 4,734,706 | A | 3/1988 | Le et al. |
| 5,539,437 | A | 7/1996 | Penwell |
| 6,296,452 | B1 | 10/2001 | Caren |
| 6,312,109 | B1 | 11/2001 | Chen |
| 6,470,106 | B2 | 10/2002 | McClelland et al. |
| 6,705,716 | B2 | 3/2004 | Mott |
| 8,727,501 | B2 | 5/2014 | Xie et al. |
| 2015/0124012 | A1* | 5/2015 | Hays ..... B41J 2/07 347/9 |

OTHER PUBLICATIONS

IP.com search (Year: 2019).*

* cited by examiner

*Primary Examiner* — Lisa Solomon
(74) *Attorney, Agent, or Firm* — Gary A. Kneezel

(57) ABSTRACT

A drop ejection system includes a working fluid source containing a working fluid, an ink source containing an ink that is immiscible with the working fluid, and at least one drop ejector array module. Each drop ejector array module includes a substrate and an array of drop ejectors disposed on the substrate. Each drop ejector includes a nozzle; an ink inlet connected to the ink source; a working fluid inlet connected to the working fluid source; a pressure chamber in fluidic communication with the nozzle, the ink inlet, and the working fluid inlet; and a heating element configured to selectively vaporize a portion of the working fluid to pressurize the pressure chamber for ejecting ink drops through the nozzle.

20 Claims, 14 Drawing Sheets

FIG. 1 – PRIOR ART

DROP EJECTION USING IMMISCIBLE WORKING FLUID AND INK

CROSS REFERENCE TO RELATED APPLICATIONS

This application is a divisional application of U.S. application Ser. No. 15/436,888 filed Feb. 20, 2017.

FIELD OF THE INVENTION

This invention pertains to the field of inkjet printing and more particularly to an improved system and method for ejecting drops of ink.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. This former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a conventional drop-on-demand thermal inkjet printhead includes a pressure chamber having an ink inlet for providing ink to the pressure chamber, and a nozzle for jetting drops out of the chamber. Partition walls are formed on a substrate and define pressure chambers. A nozzle plate is formed on the partition walls and includes nozzles, each nozzle being disposed over a corresponding pressure chamber. Ink enters pressure chambers by first going through an opening in the substrate, or around an edge of the substrate. A heating element, which functions as the actuator, is formed on the surface of the substrate within each pressure chamber. The heating element is configured to selectively pressurize the pressure chamber by rapid boiling of a portion of the ink in order to eject drops of ink through the nozzle when an energizing pulse of appropriate amplitude and duration is provided.

Because portions of the ink itself are vaporized in a conventional thermal inkjet printhead, the composition and properties of the ink need to be compatible with rapid boiling without causing damage to the ink or the heating element. Such heating of some inks can cause degradation of ink components and ink properties. In addition, some inks can cause damage to the heating element or can cause a build-up of ink residue on the heating elements that can adversely affect the energy transfer efficiency of heat from the heating element into the ink. Furthermore, some inks that have desirable image forming properties do not have desirable bubble ejection properties, such as bubble nucleation factors, vapor bubble temperature, bubble formation speed and amount of force exerted on the heating element due to bubble collapse. Non-aqueous inks in particular can have poor performance in conventional thermal inkjet drop ejectors.

Because conventional thermal inkjet drop ejectors are incompatible with or have poor performance with certain types of ink, a common approach is to use piezoelectric inkjet printheads for such types of ink. However, in order to provide the required drop ejection force, piezoelectric drop ejectors require a much greater area on the substrate than thermal inkjet drop ejectors. As a result of the comparatively low packing density of piezoelectric drop ejectors, it is more difficult and more expensive to provide piezoelectric inkjet printheads having a high printing resolution and a small footprint.

Several patents, including U.S. Pat. Nos. 4,480,259, 6,312,109, 6,705,716 and 8,727,501, disclose a modified form of thermal inkjet where a bubble-driven flexible membrane is used to isolate the ink to be ejected from a working fluid that is used to provide the ejection force. FIG. 1 is adapted from FIG. 3 of U.S. Pat. No. 6,312,109 and illustrates a bubble-driven-membrane-type thermal inkjet drop ejector. In this example the drop ejector includes a dielectric substrate 21; a heating layer 22 overlaying the dielectric substrate 21, the heating layer 22 containing a resistor 23 for converting electricity into thermal energy; a heat dissipating layer 24 formed on the heating layer 22; a working fluid chamber 25 formed in the heat dissipating layer 24 and over the top surface of the resistor 23 for containing ink; a nozzle plate 26 formed over the heat dissipation layer 24 and having a nozzle 27; an ink chamber 28 formed in the nozzle plate 26 for containing ink; and a flexible membrane 29 formed between the heat dissipating layer 24 and the nozzle plate 26 to separate the working fluid chamber 25 from the ink chamber 28. Each ink chamber is formed with an ink channel 31 that receives ink from an ink supply (not shown). When a voltage pulse is applied to the resistor 23, a sudden outburst of thermal energy causes the working fluid to vaporize locally within a few microseconds, creating a bubble in the working fluid chamber 25. The expansion of the bubble causes the pressure within the working fluid chamber 25 to increase, and thus pushes the flexible membrane 29 outwards in the direction of added upward arrow 32. The sudden expansion creates a pressure wave in the working fluid. A portion of the pressure wave propagates to the ink within the ink chamber 28, and causes an ink droplet to be expelled through the nozzle 27. When the voltage pulse ceases, the bubble collapses and the flexible membrane 29 moves downward in the direction of downward arrow 33. Ink drop ejections can be generated repeatedly by controlling the voltage pulses applied to the resistor 23.

Bubble-driven-flexible-membrane-type drop ejectors have the advantage that the ink itself is not exposed to extreme heat and vaporization. Therefore, the ink can be formulated for good image-forming properties, and the working fluid can be formulated for good bubble nucleation and growth properties. However, inclusion of a flexible membrane adds manufacturing complexities and costs. In addition, repeated cycles of stretching and relaxing of the membrane can cause material fatigue, resulting in reduced device reliability and degraded performance. Furthermore, compared to conventional thermal inkjet, additional energy is required to deform the membrane for transferring the pressure wave from the working fluid to the ink, so that energy efficiency is decreased. Also, the membrane presents additional fluidic impedance to the working fluid moving toward the nozzle 27 in the direction of upward arrow 32, so that as the bubble expands, a greater amount of pressure and working fluid is directed toward working fluid channel 30. This can cause undesirable fluidic crosstalk in the working fluid passageways (working fluid channels 30 and working fluid chambers 25) of neighboring drop ejectors. In addition, for greater responsiveness of the membrane, it can be advantageous to design the membrane, working fluid and ink to form an underdamped system. However, when the flexible membrane 29 moves downward in the direction of downward arrow 33 in an underdamped system, it does not stop in the rest position shown in FIG. 1, but rather overshoots the rest position due to elastic restoring forces and the membrane 29 bulges somewhat toward the resistor 23. This tends to push additional working fluid from working fluid chamber 25 into working fluid channel 30. This wastes energy and also can cause additional undesirable fluidic crosstalk in the working fluid passageways of neighboring drop ejectors. As a result, the maximum allowed frequency of stable drop ejection can be decreased, so that the printing throughput is reduced.

Despite the previous advances in the use of working fluids to provide the drop ejection forces from heating elements to inks having poor compatibility with conventional thermal inkjet drop ejectors, improved systems and methods for ejecting drops using working fluids are still needed for reducing manufacturing complexities and costs, for improving reliability, for increasing energy efficiency, and for increasing printing throughput.

SUMMARY OF THE INVENTION

According to an aspect of the present invention, a drop ejection system includes a working fluid source containing a working fluid, an ink source containing an ink that is immiscible with the working fluid, and at least one drop ejector array module. Each drop ejector array module includes a substrate and an array of drop ejectors disposed on the substrate. Each drop ejector includes a nozzle; an ink inlet connected to the ink source; a working fluid inlet connected to the working fluid source; a pressure chamber in fluidic communication with the nozzle, the ink inlet, and the working fluid inlet; and a heating element configured to selectively vaporize a portion of the working fluid to pressurize the pressure chamber for ejecting ink drops through the nozzle.

According to another aspect of the present invention, a method is provided for operating an immiscible working fluid ink drop ejection system. At least one drop ejector is provided, where each drop ejector includes a nozzle, an ink inlet, a working fluid inlet, a pressure chamber, and a heating element. The method includes opening a first valve disposed between a working fluid source and the working fluid inlet; drawing working fluid through the nozzle; closing the first valve; opening a second valve disposed between an ink source and the ink inlet; drawing ink through the nozzle, wherein the ink is immiscible with the working fluid; pulsing the heating element to form a vapor bubble in the working fluid, thereby initiating a pressure wave; transmitting the pressure wave to the ink in the pressure chamber, thereby ejecting a drop of ink through the nozzle; and repeating the pulsing and transmitting steps to eject additional drops of ink through the nozzle.

This invention combines the advantages of high nozzle density, wide ink latitude and low cost. It has the additional advantage relative to bubble-driven-flexible-membrane devices of improved energy efficiency and increased printing throughput.

Figure 1:
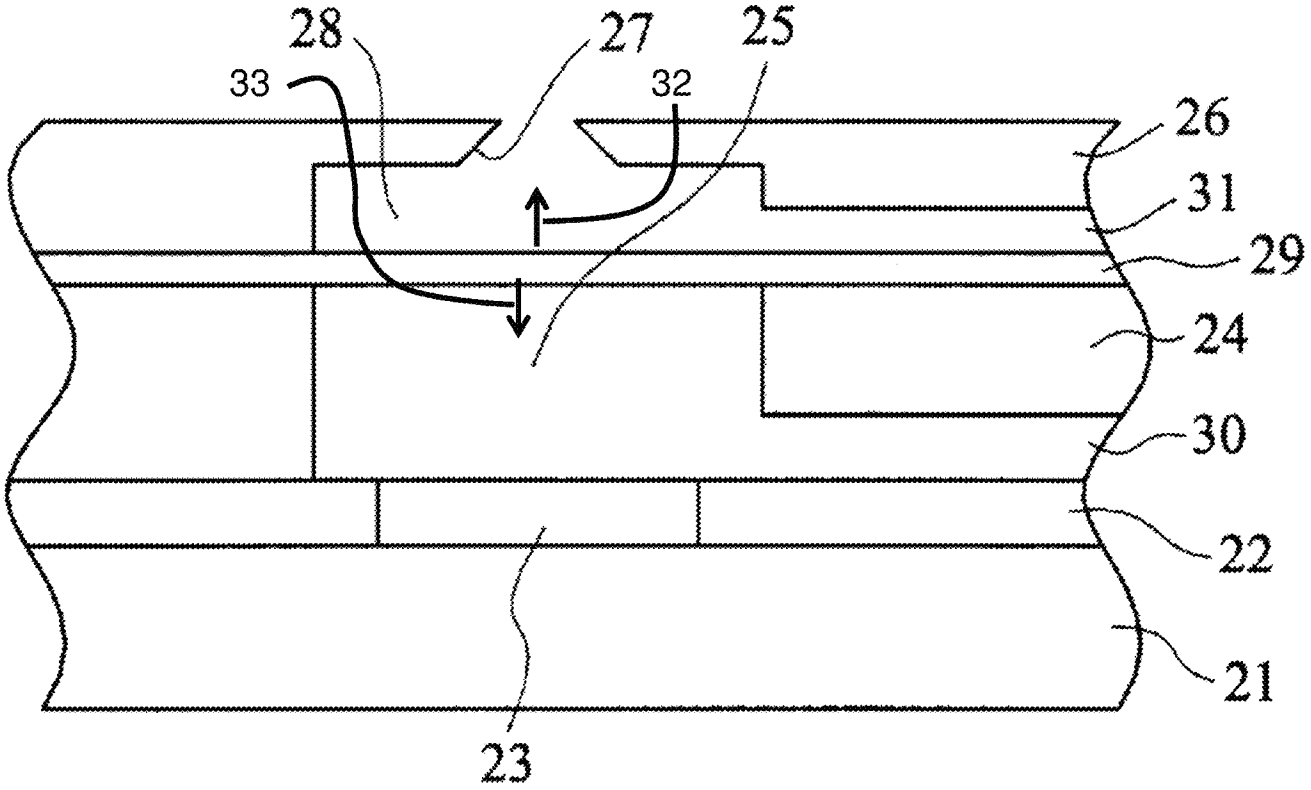
FIG. 1 shows a cross-sectional view of a prior art bubble-driven-membrane-type thermal inkjet drop ejector.

It is to be understood that the attached drawings are for purposes of illustrating the concepts of the invention and may not be to scale. Furthermore, unless otherwise specified, the drawings are not intended to imply positional or orientational relationships among elements. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. Orientation references such as upwards or downwards are not limiting. It should be noted that, unless otherwise explicitly noted or required by context, the word "or" is used in this disclosure in a non-exclusive sense.

Figure 2:
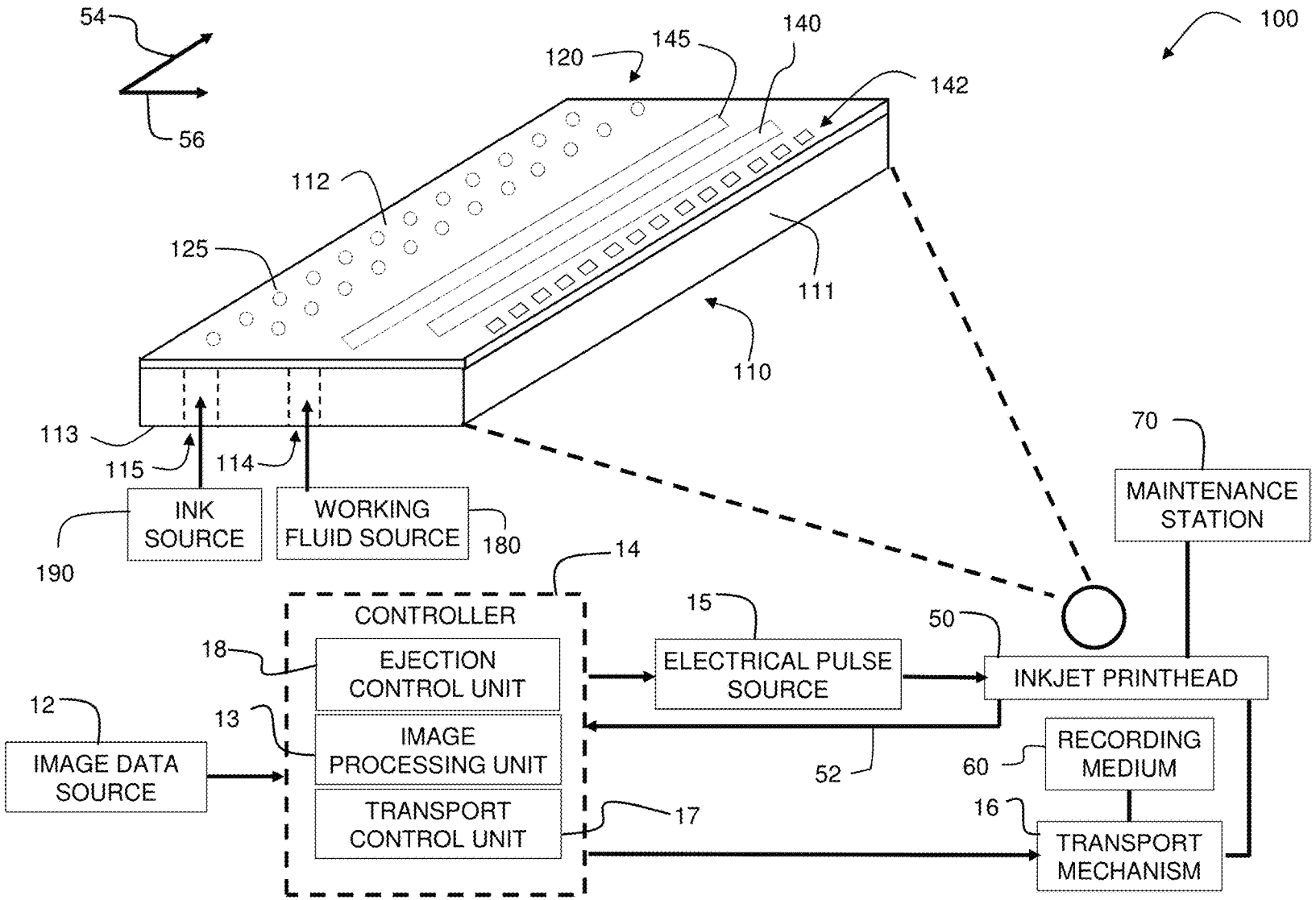
FIG. 2 is a schematic representation of a drop ejection system according to an embodiment.

FIG. 2 shows a schematic representation of an inkjet printing system 100 (also called a drop ejection system 100 herein) together with a perspective of drop ejector array module 110, according to an embodiment of the present invention. Drop ejector array module 110 can also be called a printhead die. Image data source 12 provides image data signals that are interpreted by a controller 14 as commands for ejecting drops. Controller 14 includes an image processing unit 13 for rendering images for printing. The term "image" is meant herein to include any pattern of dots directed by the image data. It can include graphic or text images. It can also include patterns of dots for printing functional devices if appropriate inks are used. Controller 14 also includes a transport control unit 17 for controlling transport mechanism 16 and an ejection control unit 18 for ejecting ink drops to print a pattern of dots corresponding to the image data on the recording medium 60. Controller 14 sends output signals to an electrical pulse source 15 for sending electrical pulse waveforms to an inkjet printhead 50 that includes at least one drop ejector array module 110. An optional printhead output line 52 is provided for sending electrical signals from the printhead 50 to the controller 14 or to sections of the controller 14, such as the ejection control unit 18. For example, printhead output line 52 can carry a temperature measurement signal from printhead 50 to controller 14. Transport mechanism 16 provides relative motion between inkjet printhead 50 and recording medium 60 along a scan direction 56. Transport mechanism 16 is configured to move the recording medium 60 along scan direction 56 while the printhead 50 is stationary in some embodiments. Alternatively, transport mechanism 16 can move the printhead 50, for example on a carriage, past stationary recording medium 60. Various types of recording media for inkjet printing include paper, plastic, and textiles. In a 3D inkjet printer, the recording media can include a flat building platform and a thin layer of powder material. In addition, in various embodiments recording medium 60 can be web fed from a roll or sheet fed from an input tray.

Drop ejector array module 110 includes at least one drop ejector array 120 including a plurality of drop ejectors 125 formed on a top surface 112 of a substrate 111 that can be made of silicon or other appropriate material. In the example shown in FIG. 2, drop ejector array 120 includes a pair of rows of drop ejectors 125 that extend along array direction 54 and that are staggered with respect to each other in order to provide increased printing resolution. Ink is provided to drop ejectors 125 by ink source 190 through ink inlet 115, which extends from the back surface 113 of substrate 111 toward the top surface 112. Ink contained in ink source 190 is generically understood herein to include any substance that can be ejected from an inkjet printhead drop ejector. Ink source 190 can contain colored ink such as cyan, magenta, yellow or black. Alternatively ink source 190 can contain conductive material, dielectric material, magnetic material, or semiconductor material for functional printing. Ink source 190 can alternatively contain biological materials, chemical materials, structural materials or other materials. Working fluid is provided to drop ejectors 125 by working fluid source 180 through working fluid inlet 114, which extends from the back surface 113 of substrate 111 toward the top surface 112. Working fluid contained in working fluid source 180 can be water or an aqueous solution including components such as a biocide or vapor bubble formation enhancers, for example. Working fluid contained in working fluid source 180 is not limited to water and aqueous solutions. As described in more detail below, the ink provided by ink source 190 is substantially immiscible with the working fluid provided by working fluid source 180. Substances are said to be immiscible if a significant proportion does not form a solution when they are in contact.

For simplicity, location of the drop ejectors 125 is represented by a circular nozzle. Drop ejector array module 110 includes a group of input/output pads 142 for sending signals to and sending signals from drop ejector array module 110 respectively. Also provided on drop ejector array module 110 in the example of FIG. 2 are logic circuitry 140 and driver circuitry 145. Logic circuitry 140 processes signals from controller 14 and electrical pulse source 15 and provides appropriate pulse waveforms at the proper times to driver circuitry 145 for actuating the drop ejectors 125 of drop ejector array 120 in order to print an image corresponding to data from image processing unit 13. Groups of drop ejectors 125 in the drop ejector array are fired sequentially so that the capacities of the electrical pulse source 15 and the associated power leads are not exceeded. A group of drop ejectors 125 is fired during a print cycle. A stroke is defined as a plurality of sequential print cycles, such that during a stroke all of the drop ejectors 125 of drop ejector array 120 are fired once. Logic circuitry 140 can include circuit elements such as shift registers, gates and latches that are associated with inputs for functions including providing data, timing, and resets.

Maintenance station 70 keeps the drop ejectors 125 of drop ejector array module 110 on printhead 50 in proper condition for reliable printing. Maintenance can include operations such as wiping the top surface 112 of drop ejector array module 110 in order to remove excess ink, or applying suction to the drop ejector array 120 in order to prime the nozzles. Maintenance operations can also include spitting, i.e. the firing of non-printing ink drops into a reservoir in order to provide fresh ink to the pressure chambers and the nozzles, especially if the drop ejectors have not been fired recently. Volatile components of the ink can evaporate through the nozzle over a period of time and the resulting increased viscosity can make jetting unreliable.

Figure 3A:
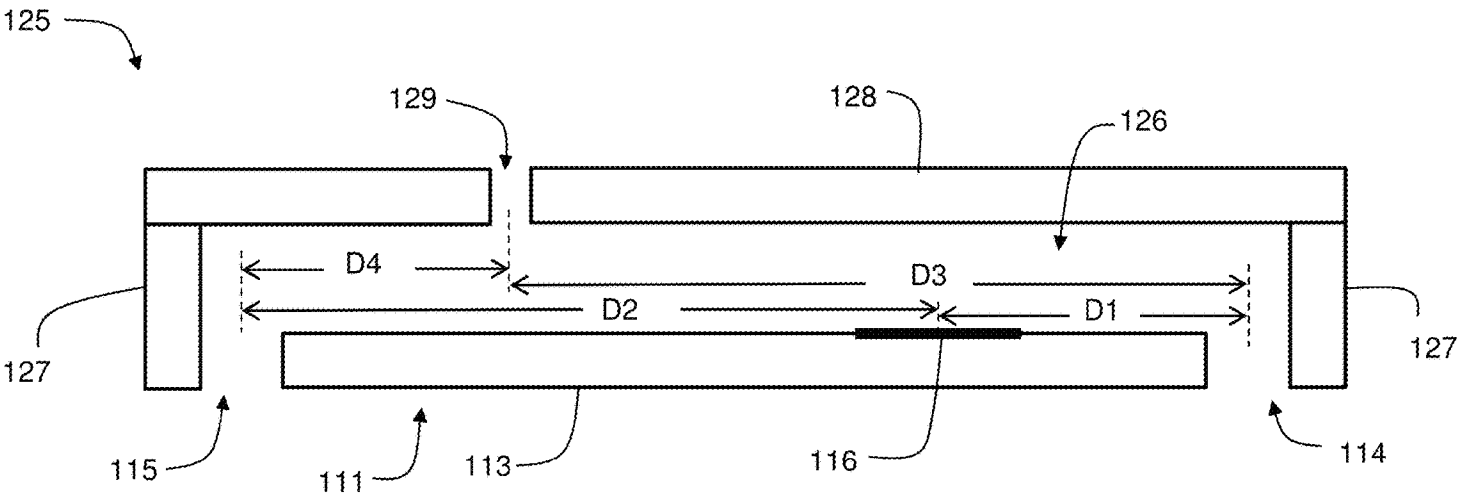
FIG. 3A shows a cross-sectional view and FIG. 3B shows a top view of a drop ejector according to an embodiment.
Figure 3B:
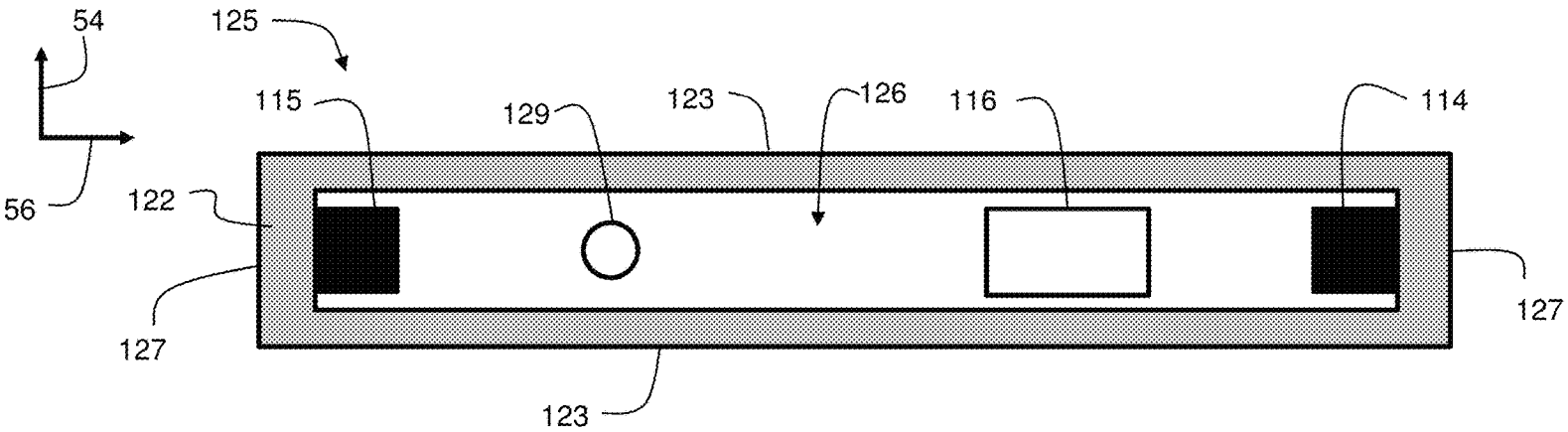

FIG. 3A shows a cross-sectional view and FIG. 3B shows a top view of an embodiment of a drop ejector 125 in greater detail. Heating element 116 is formed on substrate 111 within pressure chamber 126. Substrate 111 defines the bottom of the pressure chamber 126. End walls 127 and side walls 123 define the lateral boundaries of the pressure chamber 126 and are formed in a barrier layer 122 that can be a patterned polymer layer such as polyimide or epoxy for example. End walls 127 are separated from each other along scan direction 56, and side walls 123 are separated from each other along array direction 54. A nozzle plate 128 including a nozzle 129 defines the top of the pressure chamber 126. The top view of FIG. 3B is shown as if nozzle plate 128 is transparent, so that the inner features of pressure chamber 126 can be seen more clearly. Working fluid inlet 114 and ink inlet 115 are formed through substrate 111 and extend from the back surface 113 of the substrate to the pressure chamber 126. In other words, pressure chamber 126 is in fluidic communication with the nozzle 129, the ink inlet 115 and the working fluid inlet 114 as is described in more detail below.

Center-to-center distances between various elements in the drop ejector 125 are shown in FIG. 3A. D1 is a first distance between the heating element 116 and the working fluid inlet 114. D2 is a second distance between the heating element 116 and the ink inlet 115. First distance D1 is less than second distance D2. In other words, the heating element 116 is closer to the working fluid inlet 114 than it is to ink inlet 115. D3 is a third distance between the nozzle 129 and the working fluid inlet 114. D4 is a fourth distance between the nozzle 129 and the ink inlet 115. Fourth distance D4 is less than third distance D3. In other words, the nozzle 129 is closer to the ink inlet 115 than it is to the working fluid inlet 114. These geometrical relationships are preferred embodiments but are not intended to be limiting.

Figure 4:
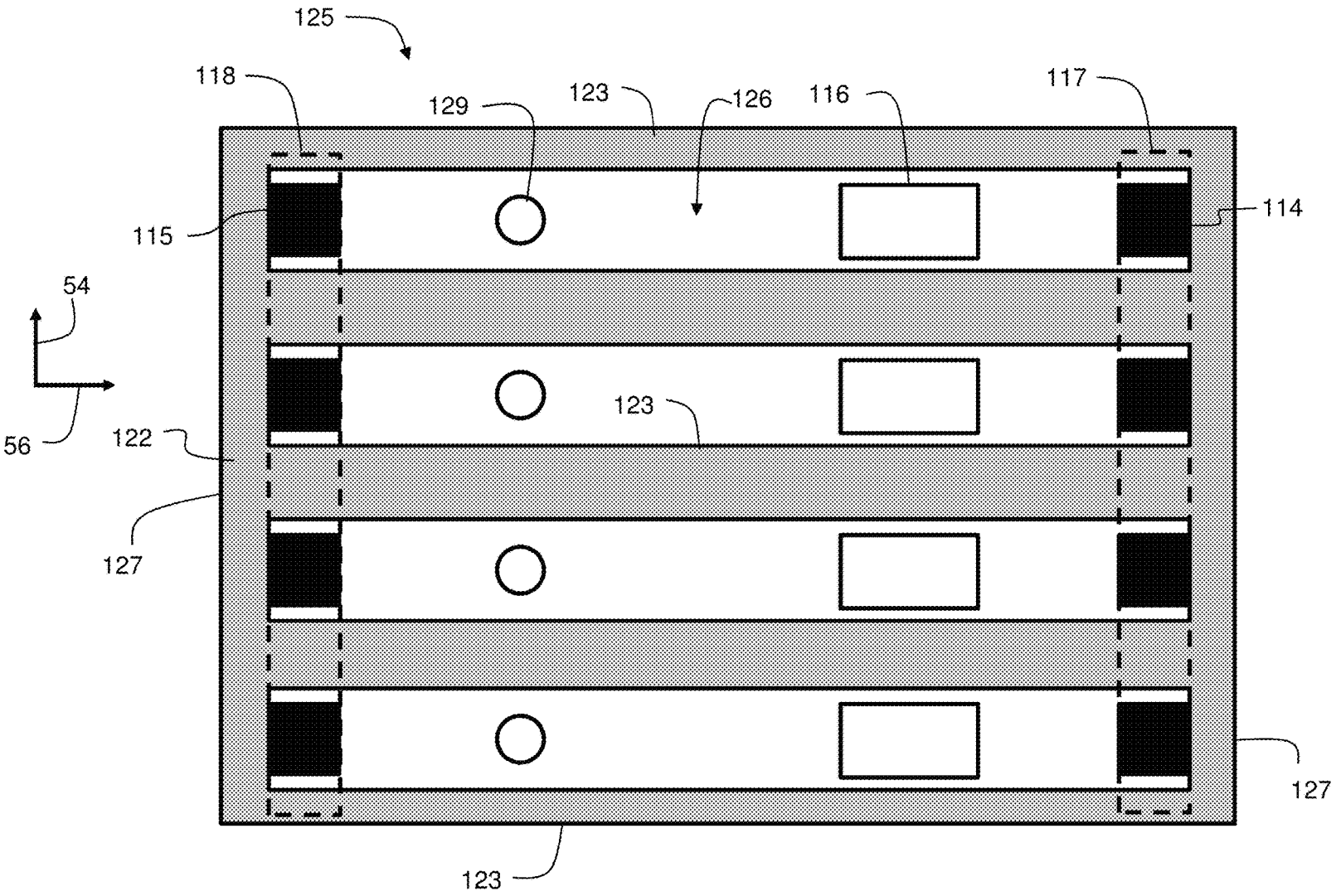
FIG. 4 shows a top view of a group of neighboring drop ejectors according to an embodiment.

FIG. 4 shows a top view of a row of four neighboring drop ejectors 125 that are separated from each other along array direction 54 by side walls 123. Each drop ejector includes a working fluid inlet 114, an ink inlet 115, a heating element 116, a nozzle 129 and a pressure chamber 126. In the example shown in FIG. 4, a working fluid passageway 117 fluidically connects the working fluid inlets 114 of the four drop ejectors 125, and an ink passageway 118 fluidically connects the ink inlets 115 of the four drop ejectors 125.

Figure 5:
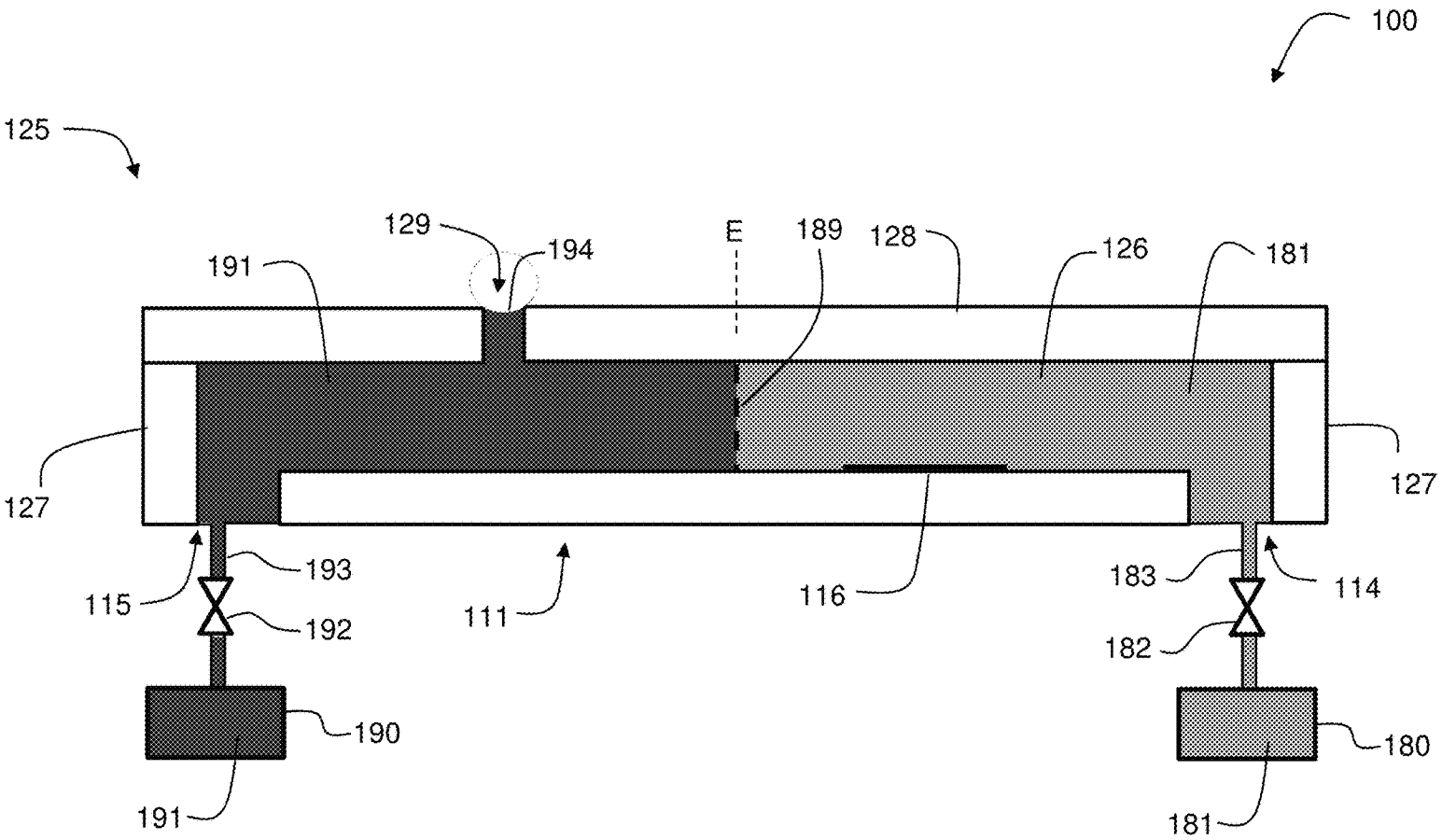
FIG. 5 shows a cross-sectional view of the drop ejector of FIG. 3A filled with working fluid and ink that is immiscible with the working fluid.

FIG. 5 shows a schematic of a portion of inkjet printing system 100 including a cross-sectional view of drop ejector 125 similar to that shown in FIG. 3A. FIG. 5 also shows the working fluid source 180 that contains working fluid 181, the ink source 190 that contains ink 191, and associated elements according to an embodiment. Features associated with the drop ejector 125 are magnified in FIG. 5 relative to the working fluid source 180 and the ink source 190 in order to more clearly show what occurs within the pressure chamber 126. In addition, although the nozzle 129 is shown as being positioned above the substrate 111, and the working fluid source 180 and ink source 190 are shown as being positioned closer to the substrate 111 than they are to the nozzle plate 128, in many drop ejection system embodiments the positional and orientational relationships are different than as shown in FIG. 5. A first conduit 183 brings working fluid 181 from working fluid source 180 to working fluid inlet 114 and into pressure chamber 126 (e.g. via the working fluid passageway 117 shown in FIG. 4). A first valve 182 is disposed between the working fluid source 180 and the working fluid inlet 114. When it is said herein that the working fluid inlet 114 is connected to the working fluid source 180, it is understood that this can include indirect connection through first valve 182. A second conduit 193 brings ink 191 from ink source 190 to ink inlet 115 and into pressure chamber 126 (e.g. via the ink passageway 118 shown in FIG. 4). A second valve 192 is disposed between the ink source 190 and the ink inlet 115. When it is said herein that the ink inlet 115 is connected to the ink source 190, it is understood that this can include indirect connection through second valve 192. Ink 191 extends into nozzle 129 and forms a meniscus 194.

Unlike the prior art bubble-driven-flexible-membrane type drop ejectors described above, in the embodiments of the present invention there is no structural barrier within the drop ejector 125 that isolates the ink 191 from the working fluid 181. Rather, the immiscibility of the ink 191 with the working fluid 181 permits direct contact of the ink 191 with the working fluid 181 within the pressure chamber 126 at a fluid interface 189, which is represented as a dashed straight line for simplicity. As a result, the pressure chamber 126 is in fluidic communication with the nozzle 129, the ink inlet 115 and the working fluid inlet 114. As used herein, the term immiscible does not mean that no portion of the working fluid 181 can mix in solution with the ink 191, but rather that a stable fluid interface 189 can be formed between the working fluid 181 and the ink 191. The shape of the fluid interface 189 depends upon the characteristics of the ink 191 and the working fluid 181, as well as the surface wetting characteristics and internal pressure distribution within the pressure chamber 126. FIG. 5 shows an equilibrium condition such that fluid interface 189 is located at an equilibrium position E between the heating element 116 and the nozzle 129. The shape of the meniscus 194 also depends upon ink characteristics and surface wetting characteristics, as well as the pressure within pressure chamber 126.

Figure 6:
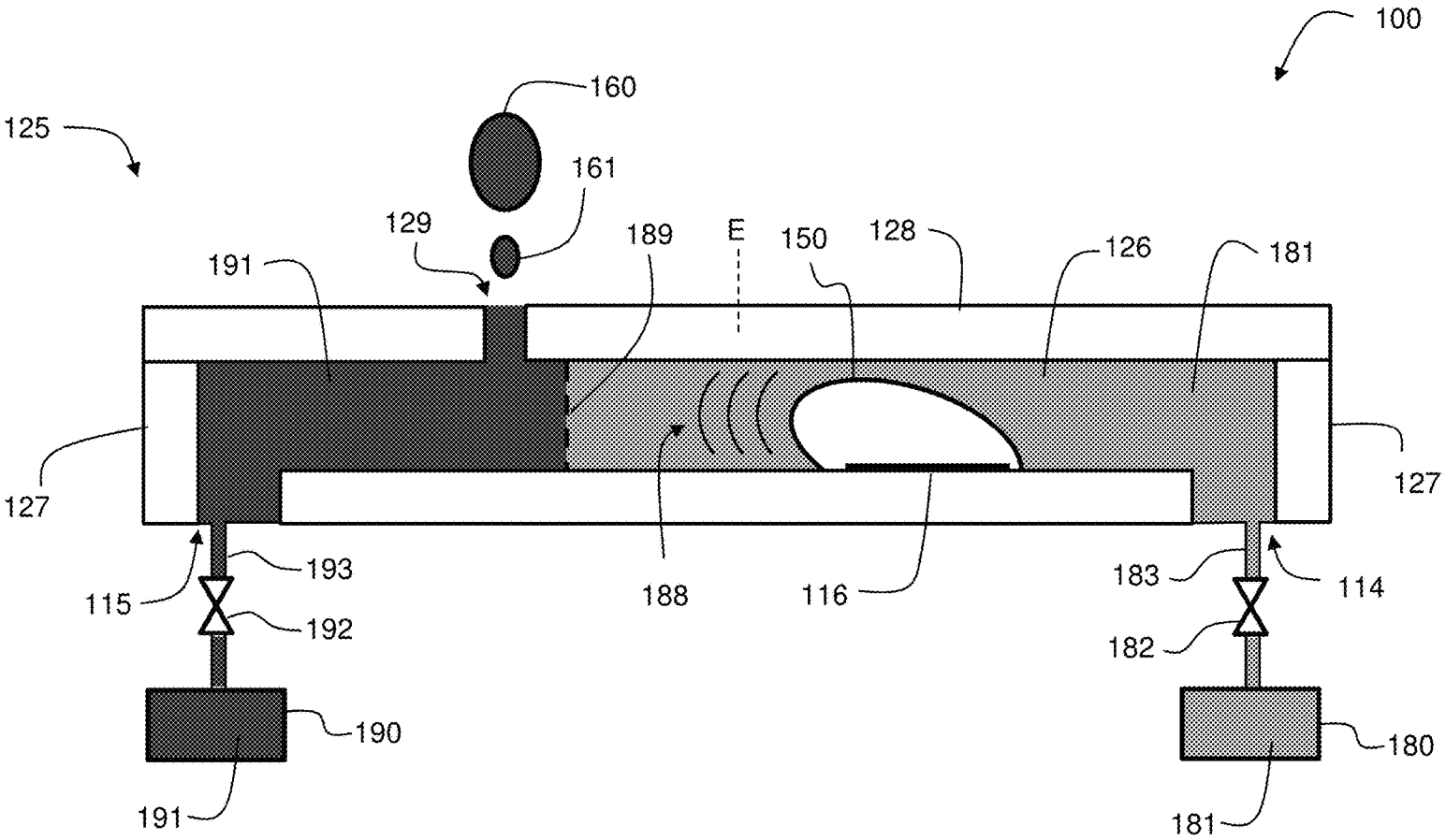
FIG. 6 shows the drop ejector of FIG. 5 after a vapor bubble is formed in the working fluid for ejecting a drop of ink.

FIG. 6 is similar to FIG. 5 but shows what happens after providing resistive heating element 116 with an electrical pulse having sufficient energy to nucleate and grow a vapor bubble 150 in the working fluid 181. Because the working fluid 181 is in contact with heating element 116, the heating element 116 is configured to selectively vaporize a portion of the working fluid 181. The expansion of vapor bubble 150 pressurizes the pressure chamber 126 and initiates a pressure wave 188 in the working fluid 181 that moves the fluid interface 189 from its equilibrium position E toward the nozzle 129. The pressure wave 188 is transmitted to the ink 191 in the pressure chamber 126, thereby ejecting a drop of ink 160 through the nozzle 129. One or more satellite drops 161 may also be ejected. Second valve 192 is open during drop ejection so that ink 191 can be replenished in pressure chamber 126 as drops of ink 160 are ejected. In FIG. 6 the vapor bubble 150 is schematically shown as preferentially expanding in a direction toward the nozzle 129. The actual shape of the vapor bubble 150 will depend upon factors such as the relative magnitudes of the forward fluid impedance from the heating element 116 toward the nozzle 129 and the backward fluid impedance from the heating element 116 toward the working fluid inlet 114. In some embodiments, the first valve 182 is closed during times when heating elements 116 are pulsed for ejecting drops of ink 160 in order to increase the backward fluid impedance. Because small amounts of working fluid 181 can be ejected with the ink 191 in some embodiments, the first valve 182 can be opened at least occasionally, such as when drops of ink 160 are not being ejected, in order to replenish the working fluid 181 in the pressure chamber 126. An electrical pulse for forming a transient vapor bubble 150 has a pulse width that is typically on the order of one microsecond, depending upon the properties of the working fluid 181. Once the vapor bubble 150 has grown to the extent that liquid working fluid 181 is no longer in contact with the heating element 116, the conduction of heat from the heating element 116 into the working fluid 181 dramatically decreases. Electrical pulse widths are typically designed such that the pulse ends about the time that the formation of a film of vapor bubble 150 starts to separate contact between the heating element 116 and the working fluid 181. The vapor bubble 150 continues to grow during a vapor bubble expansion period. As the heating element 116 cools after the pulse ends, the pressure inside the vapor bubble 150 becomes negative and the transient vapor bubble 150 collapses. As the vapor bubble 150 collapses during the vapor bubble collapsing period, the working fluid 181 that had been displaced by the vapor bubble 150 moves toward the heating element 116. As a result of the vapor bubble 150 collapsing, the fluid interface 189 moves back toward its equilibrium position E, i.e. back toward the heating element 116. In order to eject additional drops of ink 160, the steps of pulsing the heating element 116 to initiate a pressure wave 188, and transmitting the pressure wave 188 to the ink 191 are repeated following the collapse of the vapor bubble 150. In order to provide well-controlled drop ejection it is preferable to delay the subsequent pulsing of the heating element 116 until the fluid interface 189 is substantially stabilized. It is not required that all motion of the fluid interface 189 has stopped for the fluid interface 189 to be considered substantially stabilized, but the amplitude of oscillation of the fluid interface 189 prior to the next pulse should be much less (20% or less) than the maximum displacement of the fluid interface 189 during drop ejection.

Figure 7:
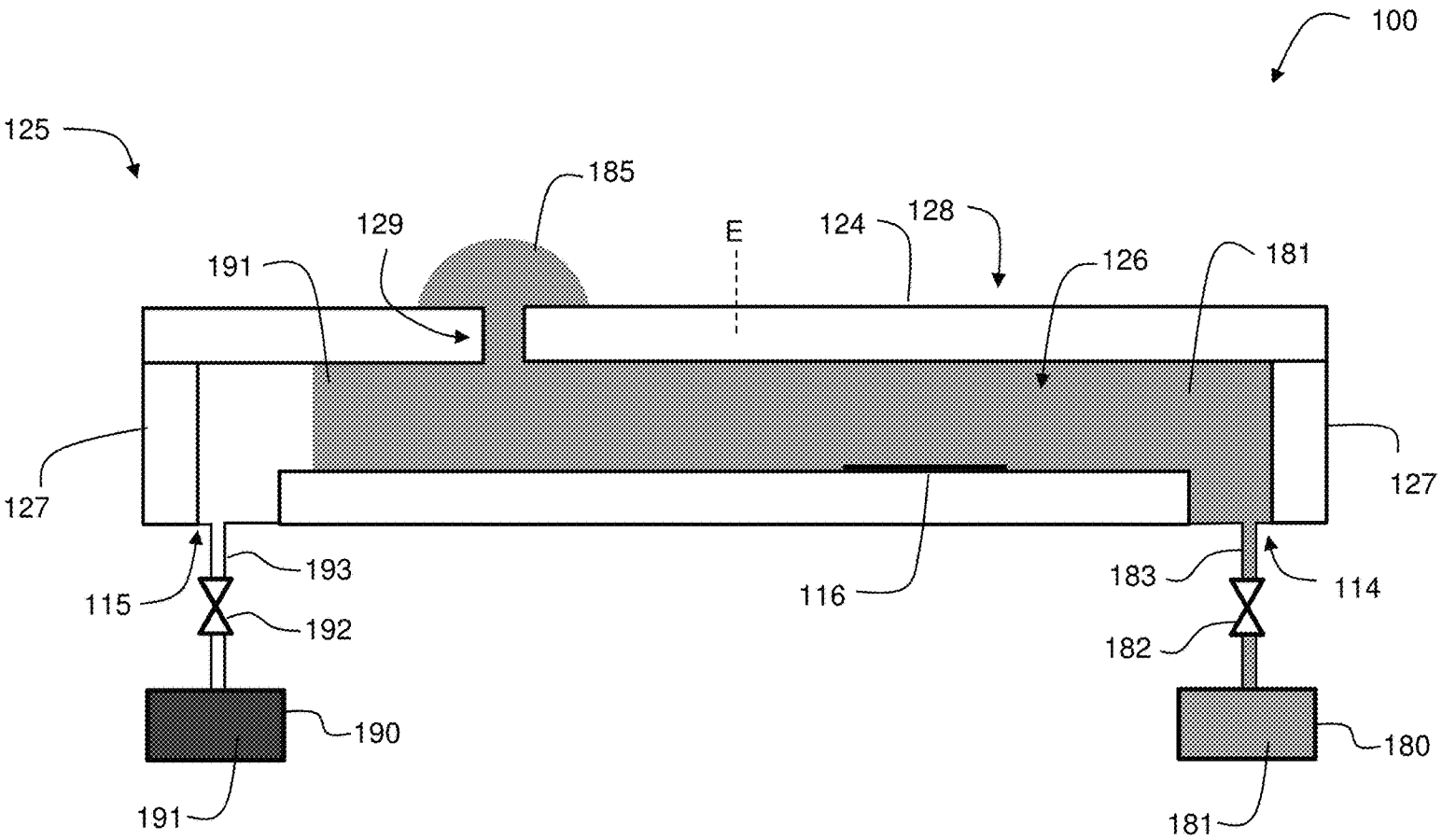
FIG. 7 shows the drop ejector of FIG. 3A as working fluid is introduced into the pressure chamber.
Figure 8:
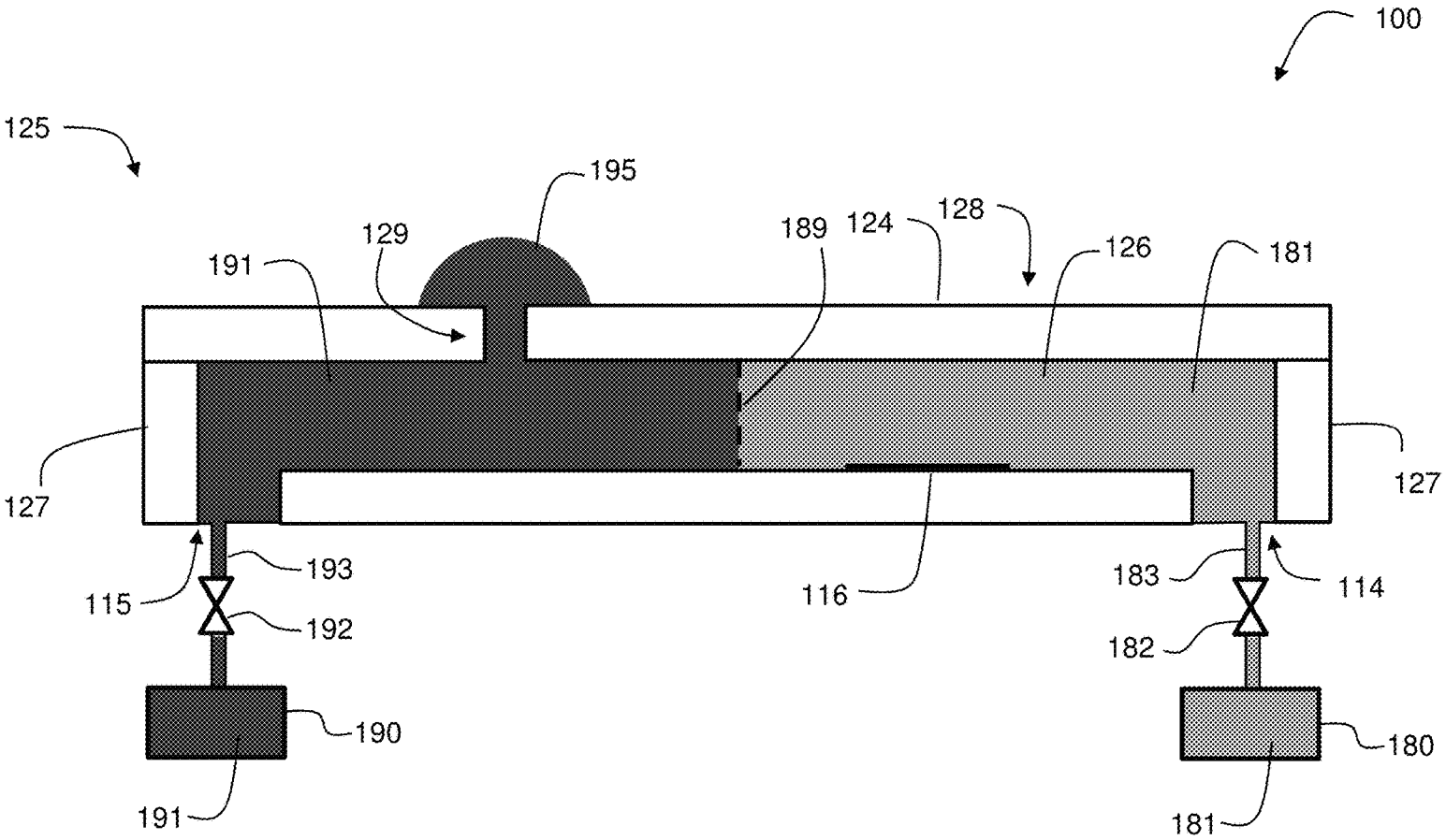
FIG. 8 shows the drop ejector of FIG. 7 as ink is introduced into the pressure chamber.

FIGS. 7 and 8 are similar to FIG. 5 and illustrate a method of filling the pressure chamber 126 with working fluid 181 (FIG. 7) and then with ink 191 (FIG. 8). In FIG. 7 the first valve 182 is opened so that working fluid 181 can flow from working fluid source 180 through first conduit 183 and working fluid inlet 114 into pressure chamber 126. Working fluid 181 is drawn along pressure chamber 126 and out through nozzle 129. This can be done by providing a pressure differential between the working fluid inlet 114 and the nozzle 129. For example, a positive pressure can be provided at working fluid inlet 114, or suction can be provided at nozzle 129. Excess working fluid 185 is shown extending through nozzle 129 and accumulating on an outer surface 124 of nozzle plate 128. The excess working fluid 185 can be removed from the outer surface 124 by wiping, by removal of the pressure differential between the working fluid inlet 114 and the nozzle 129, or by surface wetting characteristics of the outer surface 124 and the inner surfaces of pressure chamber 126 for example. Typically, the second valve 192 remains closed while the working fluid 181 is introduced into the pressure chamber 126.

FIG. 8 illustrates the subsequent step of introducing ink 191 into the pressure chamber 126. The first valve 182 is closed and the second valve 192 is opened so that ink 191 can flow from ink source 190 through second conduit 193 and ink inlet 115 into pressure chamber 126. Ink 191 is drawn along pressure chamber 126 and out through nozzle 129. This can be done by providing a pressure differential between ink inlet 115 and the nozzle 129. Excess ink 195 is shown extending through nozzle 129 and accumulating on an outer surface 124 of nozzle plate 128. The excess ink 195 can be removed from the outer surface 124 by wiping, by removal of the pressure differential between the ink inlet 115 and the nozzle 129, or by surface characteristics of the outer surface 124 and the inner surfaces of pressure chamber 126. Ink 191 is drawn into pressure chamber 126 until the ink 191 is in direct contact with the working fluid 181 at fluid interface 189.

Immediately after drawing the ink 191 into the pressure chamber 126, the fluid interface 189 can be too close to the nozzle 129. One method for positioning the fluid interface 189 in the equilibrium position E (FIG. 5) farther away from the nozzle 129 is to eject a few maintenance drops by successive pulsing of heating element 116. Excess working fluid 181 is ejected together with ink 191 during the ejection of the maintenance drops. The working fluid 181 is not replenished because first valve 182 is closed. As a result, the amount of working fluid 181 in the pressure chamber 126 is decreased, the amount of ink 191 in the pressure chamber 126 is increased, and the fluid interface 189 moves away from the nozzle 129 and toward the equilibrium position E. A second method that can be used to move the fluid interface 189 farther away from the nozzle 129 is to open the first valve 182 and apply a negative pressure at the working fluid inlet 114 so that some working fluid 181 is removed from the pressure chamber 126. Because the second valve 192 is still open, ink 191 is drawn into the pressure chamber 126 to replace the working fluid 181 that was removed. As a result, the fluid interface 189 moves away from the nozzle 129 and toward the equilibrium position E. Then the first valve 182 is closed again.

Summarizing the above, a method of operating an immiscible working fluid ink drop ejection system 100 includes: providing at least one drop ejector 125, each drop ejector 125 including a nozzle 129, an ink inlet 115, a working fluid inlet 114, a pressure chamber 126, and a heating element 116; opening a first valve 182 disposed between a working fluid source 180 and the working fluid inlet 114; drawing working fluid 181 through the nozzle 129; closing the first valve 182; opening a second valve 192 disposed between an ink source 190 and the ink inlet 115; drawing ink 191 through the nozzle 129, wherein the ink 191 is immiscible with the working fluid 181; pulsing the heating element 116 to form a transient vapor bubble 150 in the working fluid 181, thereby initiating a pressure wave 188; transmitting the pressure wave 188 to the ink 191 in the pressure chamber 126, thereby ejecting a drop of ink 160 through the nozzle 129; and repeating the pulsing and transmitting to eject additional drops of ink 160 through the nozzle 129. In the embodiment described above, drawing ink 191 through the nozzle 127 causes a fluid interface 189 to be formed between the ink 191 and the working fluid 181 within the pressure chamber 126 between the heating element 116 and the nozzle 129. In the embodiment described above, transmitting the pressure wave 188 to the ink 191 includes moving the fluid interface 189 toward the nozzle 129 during a vapor bubble expansion period. Subsequently the fluid interface 189 moves toward the heating element 116 during a vapor bubble collapsing period. Furthermore in the embodiment described above, the method includes substantially stabilizing the fluid interface 189 before repeating the pulsing and transmitting steps.

Aqueous liquids, such as those used in convention thermal inkjet inks, typically have physical properties that provide good bubble nucleation and bubble growth, but also have other components such as dyes and pigments that are less preferable to expose to the extreme heating conditions experienced by a conventional thermal inkjet ink. In some embodiments, working fluid 181 is an aqueous fluid, and the ink 191, which is immiscible with the working fluid 181, is a non-aqueous fluid. For example, ink 191 can be an oil-based liquid and working fluid 181 can be a water-based liquid.

In some embodiments it is advantageous for the ink 191 to be solid at room temperature but liquid at a temperature that is between room temperature and the boiling point of the working fluid 181. When the drop ejection system 100 is idle at room temperature, the solidified ink 191 keeps volatile fluid components from evaporating and keeps particulates from entering the nozzle 129. In such embodiments the drop ejector array module 110 is operated at a temperature that is above room temperature and above the melting temperature of the ink 191, but below the boiling point of the working fluid 181. In embodiments where the working fluid 181 is an aqueous solution, the ink 191 can have a melting point that is greater than 20° C. and less than 100° C. In order to ensure that the ink 191 is solid at ambient temperature it can be advantageous for the melting point to be above 30° C. In order to avoid having to expend excess energy to operate the drop ejector array at a high temperature, it can be advantageous for the ink 191 to have a melting point that is less than 60° C. or even less than 50° C. Various organic compounds such as waxes, paraffin, lipids and higher alkanes are immiscible with water and have melting points that are in the range of 30° C. to 60° C. In some embodiments, inks 191 that are oil-based, wax-based, or paraffin-based, for example, have desirable properties for forming images or other items.

Figure 9A:
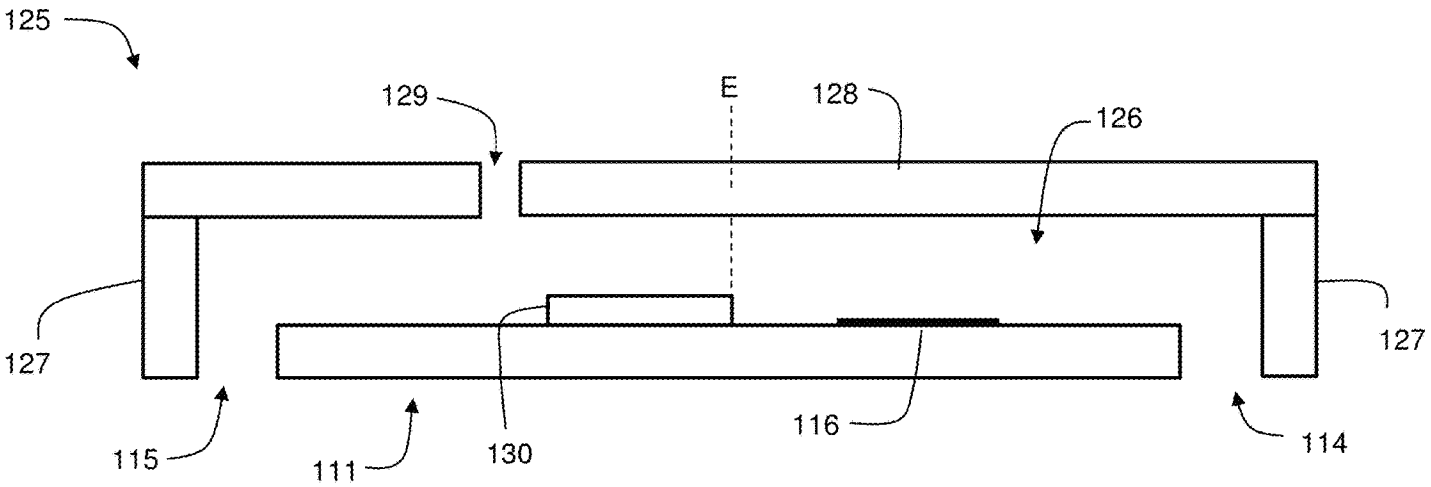
FIG. 9A shows a cross-sectional view and FIG. 9B shows a top view of a drop ejector according to an embodiment including a stabilizing feature.
Figure 9B:
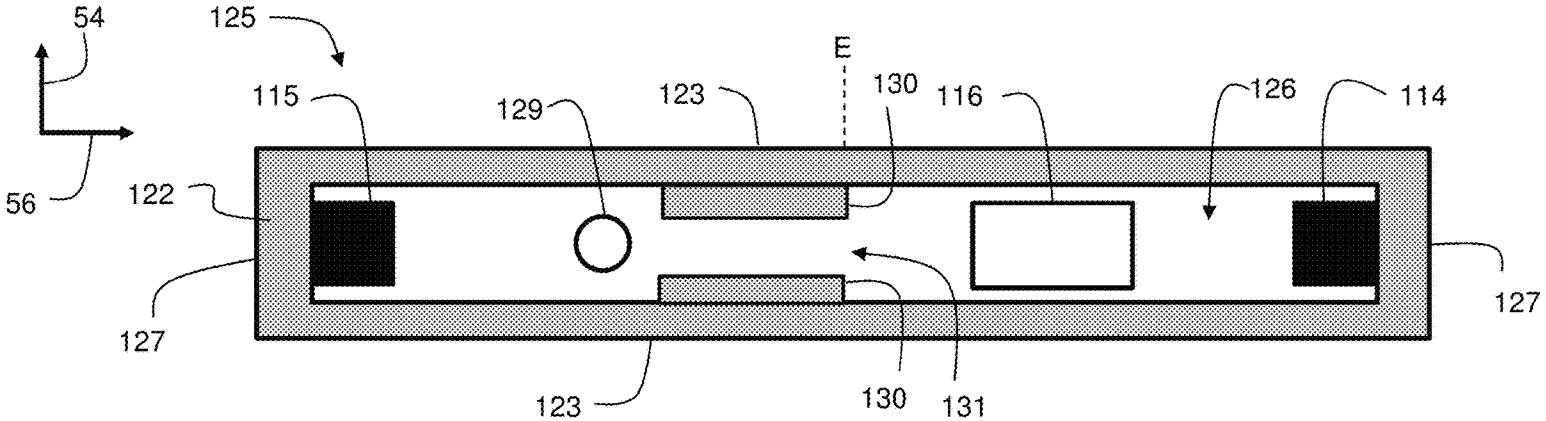

In the embodiments described above with reference to FIGS. 3A through 6, the equilibrium position E of the fluid interface 189 is determined by factors such as capillary effects, relative pressures, and properties of the working fluid 181 and the ink 191. FIG. 9A shows a cross-sectional view and FIG. 9B shows a top view of an embodiment of a drop ejector 125 that is similar to that shown in FIGS. 3A and 3B but also includes a patterned layer 130, such as a patterned polymer layer, that is formed on the substrate 111 between heating element 116 and nozzle 129. As seen in FIG. 9A, patterned layer 130 has a height that is shorter than end walls 127 in this example. As seen in FIG. 9B, patterned layer 130 extends adjacent to each of the two opposing side walls 123 of drop ejector 125, thereby forming an extended constriction 131. Extended constriction 131 terminates at or near the desired equilibrium position E and can help to stabilize a position of the fluid interface 189 after drop ejection. Although the position of the fluid interface 189 is displaced back and forth during the vapor bubble expansion period and the vapor bubble collapsing period, extended constriction 131 can function as a stabilizing feature for facilitating the return of the fluid interface 189 to a position that is at or near the equilibrium position E. In addition to or alternatively to stabilizing a position of the fluid interface 189, the extended constriction 131 can stabilize the fluid interface by helping to keep the fluid interface 189 intact as it moves back and forth along the pressure chamber 126. In other words, extended constriction 131 is an example of a stabilizing feature for stabilizing the fluid interface 189. In particular, extended constriction 131 is a stabilizing feature including a structural feature that is disposed between the heating element 116 and the nozzle 129.

Figure 10:
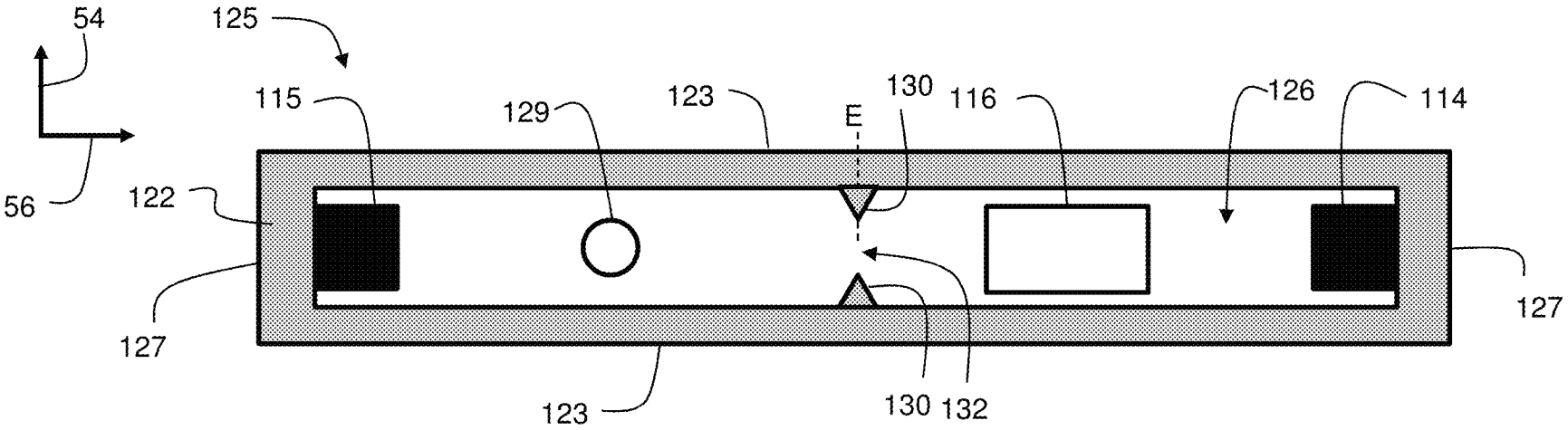
FIG. 10 shows a top view of a drop ejector according to another embodiment including a stabilizing feature.

FIG. 10 shows a top view of another embodiment of a drop ejector 125 having a stabilizing feature formed as a structural feature in a patterned layer 130 and located between the heating element 116 and nozzle 129. In the example shown in FIG. 10, patterned layer 130 is patterned to provide a localized constriction 132 that is located at or near the desired equilibrium position E. Note that neither extended constriction 131 in FIGS. 9A and 9B nor localized constriction 132 in FIG. 10 will isolate the ink 191 from the working fluid 181.

Figure 11:
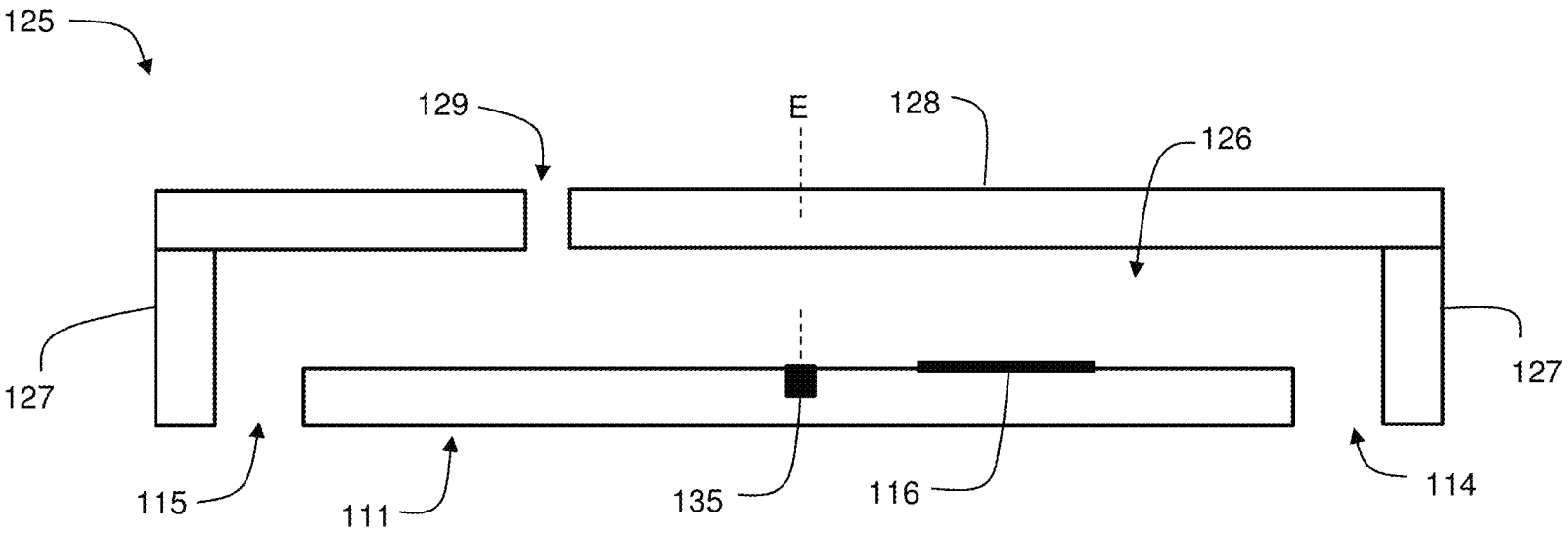
FIG. 11 shows a cross-sectional view of a drop ejector according to yet another embodiment including a stabilizing feature.

FIG. 11 shows a cross-sectional view of another embodiment of a drop ejector 125 having a stabilizing feature for stabilizing the fluid interface 189. In the example shown in FIG. 11, the stabilizing feature is a heat barrier provided by a filled trench 135 in the substrate 111. Substrate 111 is typically silicon and has excellent thermal conductivity. As a result, a portion of the heat generated by heating element 116 is conducted into the substrate 111 and conducted readily along substrate 111 toward nozzle 129. Filled trench 135 is formed by removing high thermal conductivity material from substrate 111 to form a trench and then filling the trench with a low thermal conductivity material such as a polymer. As shown in FIG. 11, the filled trench 135 is located at or near the desired equilibrium position E between the heating element 116 and the nozzle 129. An abrupt temperature difference between the portion of the substrate 111 on the side of the filled trench 135 that is closer to the heating element 116 and the portion of the substrate 111 on the side of the filled trench 135 that is farther from the heating element 116 can help to stabilize the fluid interface 189.

Figure 12:
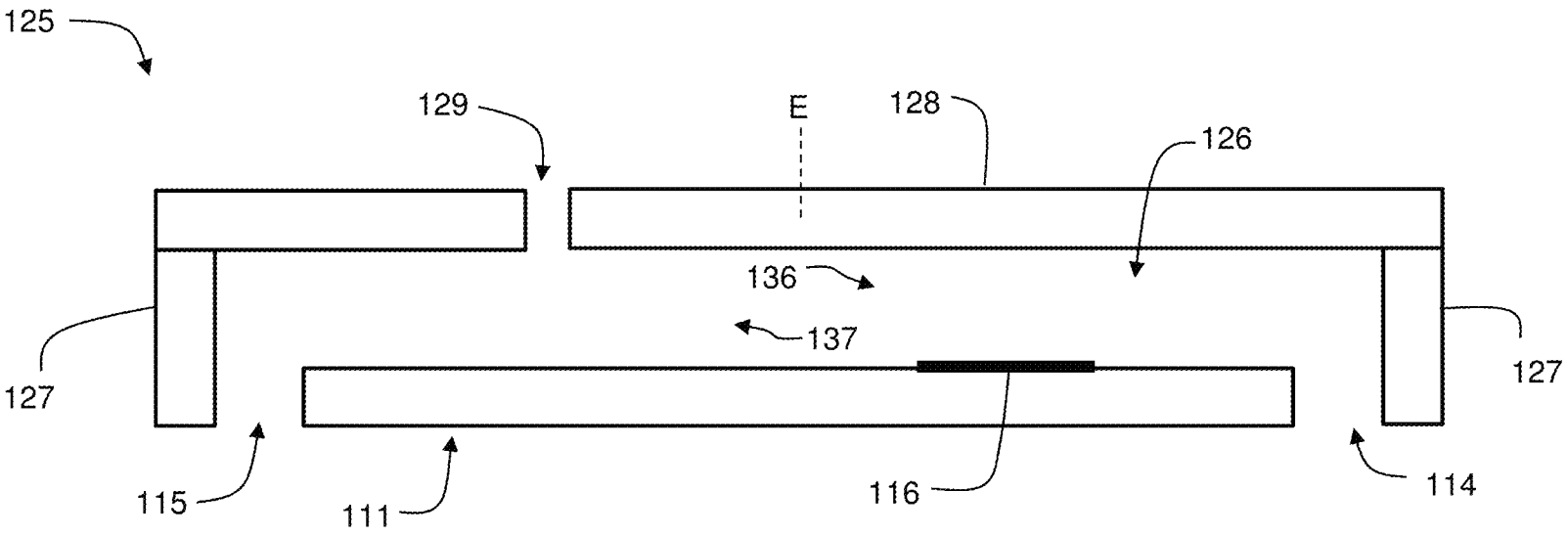
FIG. 12 shows a cross-sectional view of a drop ejector according to still another embodiment including a stabilizing feature.

Still another type of stabilizing feature can be described with reference to the cross-sectional view shown in FIG. 12. First portion 136 of the pressure chamber 126 that is proximate to the heating element 116 and distal to the nozzle 129 is provided with a first surface wetting characteristic. Second portion 137 of the pressure chamber 126 that is proximate to the nozzle 129 and distal to the heating element 116 is provided with a second surface wetting characteristic, where the second surface wetting characteristic is different from the first surface wetting characteristic. The transition between first portion 136 and second portion 137 is located at or near the desired equilibrium position E. In particular, the first surface wetting characteristic promotes contact between the working fluid 181 and one or more internal surfaces of the first portion 136 of the pressure chamber 126. The second surface wetting characteristic promotes contact between the ink 191 and one or more internal surfaces of the second portion 137 of the pressure chamber 126. Different surface wetting characteristics can be provided by different material layers, different chemical treatments or different plasma treatments for example.

Figure 13:
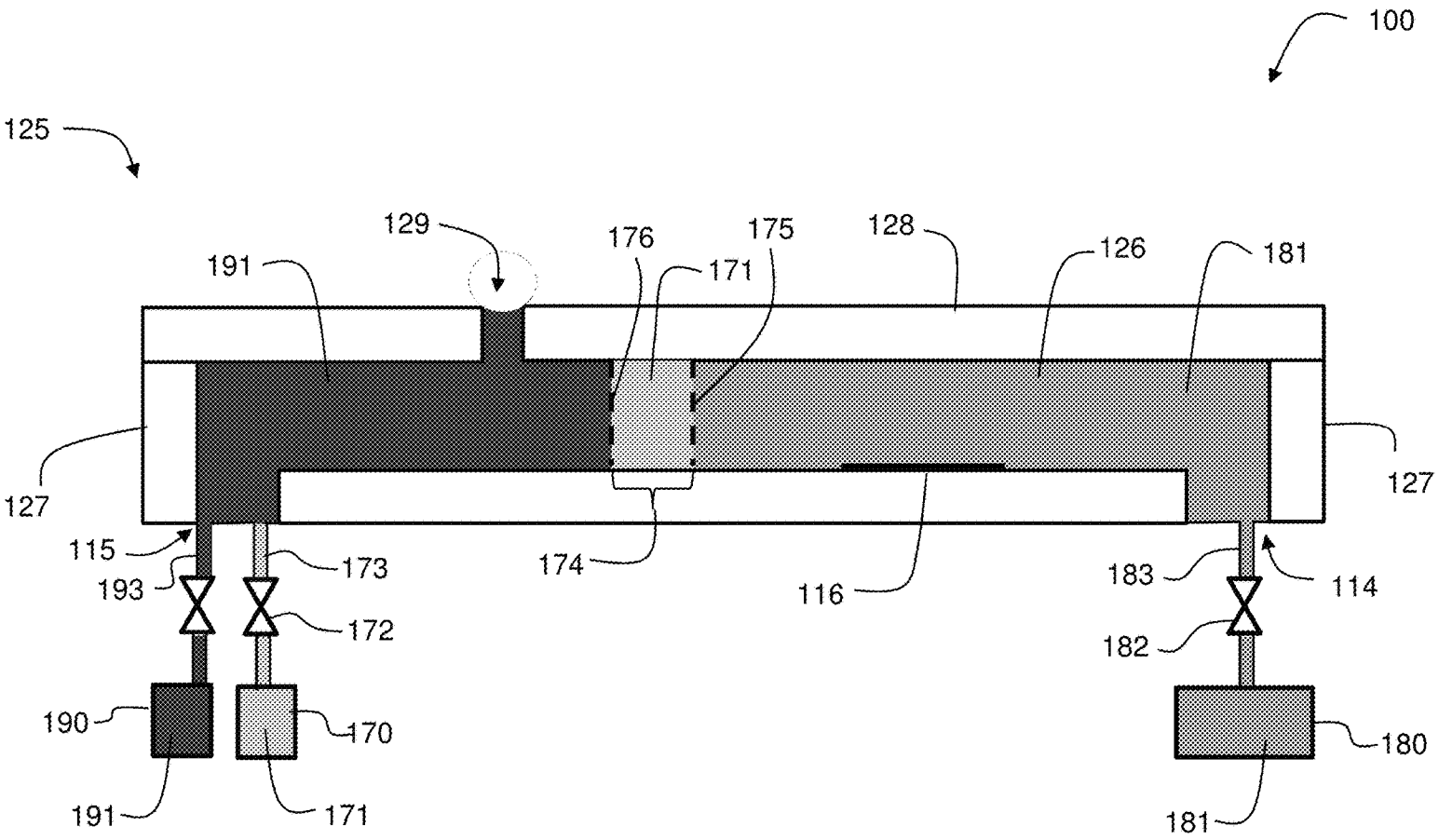
FIG. 13 shows a cross-sectional view of a drop ejector filled with a first working fluid, ink and an intervening second working fluid that is immiscible with both the ink and the first working fluid.

FIG. 13 shows a schematic of a portion of an inkjet printing system 100 including a cross-sectional view of drop ejector 125 according to another embodiment. The embodiment shown in FIG. 13 contains the elements shown in FIG. 5 and also includes a second working fluid source 170 that contains a second working fluid 171 that is immiscible with both the ink 191 and the working fluid 181. For example, second working fluid 171 can include a liquid metal. Second working fluid 171 functions as an intervening separation fluid between the ink 191 and the working fluid 181 (also referred to herein as a first working fluid 181). In such embodiments, the ink 191 can be immiscible with the first working fluid 181, but that is not required because the immiscible second working fluid 171 separates the ink 191 from the first working fluid 181. A third valve 172 is disposed between the second working fluid source 170 and the ink inlet 115. Second working fluid 171 can be introduced into pressure chamber 126 through third valve 172 and third conduit 173, which is connected to ink inlet 115. FIG. 13 shows a slug 174 of second working fluid 171 disposed between ink 191 and first working fluid 181. A first separation fluid interface 175 is formed between slug 174 and first working fluid 181. A second separation fluid interface 176 is formed between slug 174 and ink 191. When heating element 116 is pulsed and a vapor bubble 150 is formed as in FIG. 6, the resulting pressure wave 188 (FIG. 6) is transmitted to the slug 174 of second working fluid 171 so that the slug 174 is moved toward nozzle 129, thereby providing the pressure for ejecting a drop of ink 160 (FIG. 6).

Second working fluid 171 can be introduced into the pressure chamber 126 in the following way. After the first working fluid 181 has been introduced into the pressure chamber 126 as described above with reference to FIG. 7, the first valve 182 is closed and the third valve 172 is opened. Second working fluid 171 is drawn through the nozzle 129 and comes into contact with the first working fluid 181 at the first separation fluid interface 175. In order to move the first separation fluid interface 175 farther away from the nozzle 129, the third valve 172 is closed and the first valve 182 is opened. A negative pressure is applied at the working fluid inlet 114 so that some first working fluid 181 is removed from the pressure chamber 126. As a result, the first separation fluid interface 175 moves away from the nozzle 129 and toward the working fluid inlet 114. Then the first valve 182 is closed prior to the step of opening the second valve 192 to introduce ink 191 into the pressure chamber 126 as described above with reference to FIG. 8. The ink 191 comes into contact with the second working fluid 171 at the second separation fluid interface 176, thereby providing the slug 174 of second working fluid 171 disposed between the first working fluid 181 and the ink 191 in the pressure chamber 126 when the ink 191 is subsequently drawn through the nozzle 129.

Figure 14:
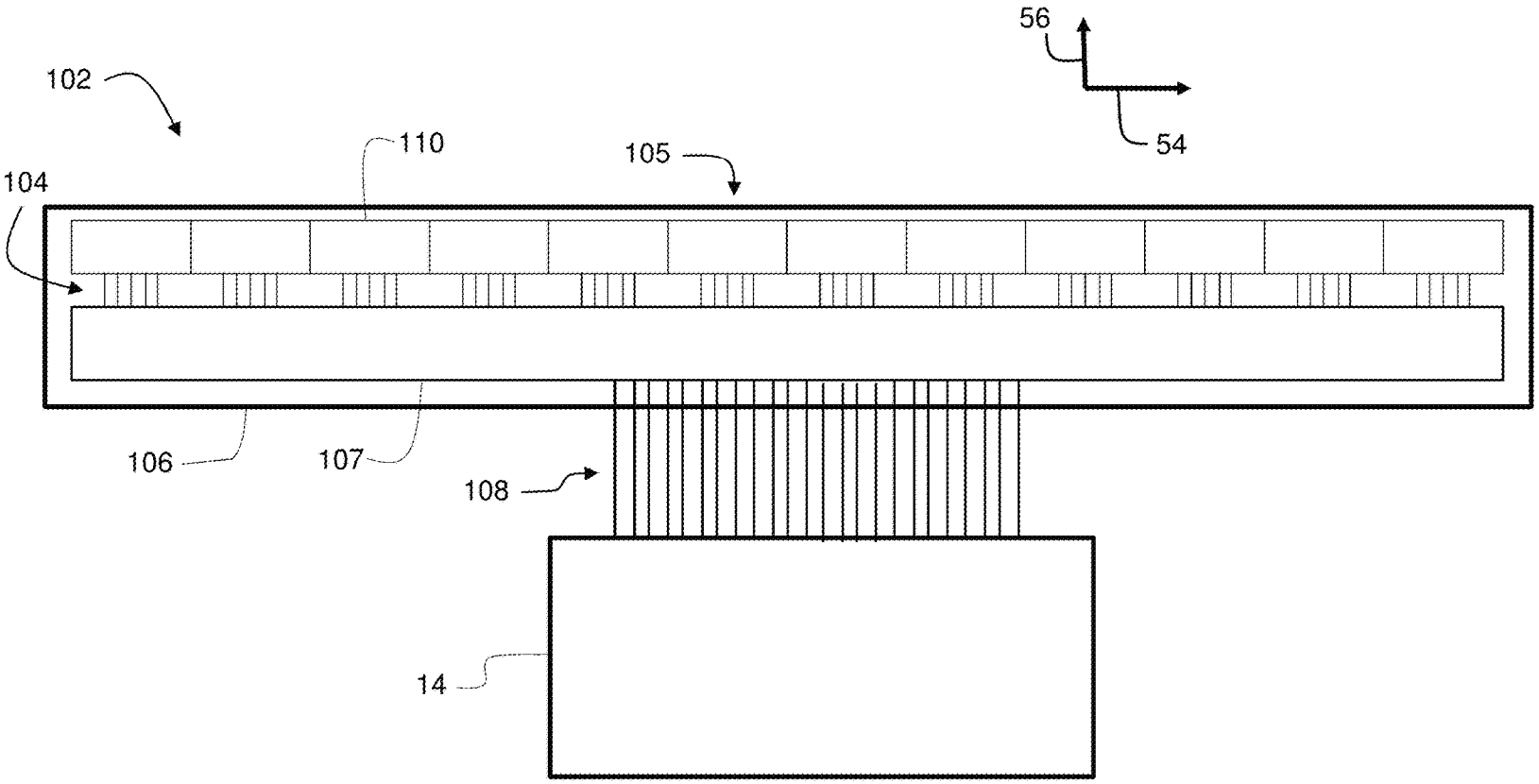
FIG. 14 shows a schematic of a portion of an inkjet printing system having a pagewidth printhead according to an embodiment.

In the embodiments described above, one or more drop ejectors 125 in a single drop ejector array module 110 are shown. Some drop ejection systems include a plurality of drop ejector array modules 110 for ejecting different types of ink or for extending the region over which ink is ejected. FIG. 14 shows a schematic of a portion of an inkjet printing system 102 having a pagewidth printhead 105 including a plurality of drop ejector array modules 110 that are arranged end to end along array direction 54 and affixed to mounting substrate 106. The drop ejector array modules 110 shown in FIG. 14 include immiscible working fluid ink drop ejectors 125 as described in various embodiments above. An interconnection board 107 is mounted on mounting substrate 106 and is connected to each of the drop ejector array modules 110 by interconnects 104 that can be wire bonds or tape automated bonding leads for example. A printhead cable 108 connects the interconnect board 107 to the controller 14. Recording medium 60 (FIG. 2) is moved along scan direction 56 by transport mechanism 16 (FIG. 2) for printing. Controller 14 controls the various functions of the inkjet printing system 102 as described above with reference to FIG. 2.

The invention has been described in detail with particular reference to certain preferred embodiments thereof, but it will be understood that variations and modifications can be effected within the spirit and scope of the invention.

The invention claimed is:

1. A drop ejection system comprising:
- a working fluid source containing a working fluid;
- an ink source containing an ink that is immiscible with the working fluid; and
- at least one drop ejector array module, each drop ejector array module including:
  - a substrate;
  - a nozzle plate;
  - an array of drop ejectors disposed on the substrate, each drop ejector including:
    - a nozzle disposed in the nozzle plate;
    - an ink inlet extending through the substrate and connected to the ink source;
    - a working fluid inlet extending through the substrate and connected to the working fluid source;
    - a pressure chamber in fluidic communication with the nozzle, the ink inlet, and the working fluid inlet, wherein the ink is in direct contact with the working fluid at a fluid interface, the pressure chamber including:
      - a top defined by the nozzle plate; and
      - a bottom defined by the substrate, the bottom being opposite to the top; and
    - a heating element disposed on the substrate within the pressure chamber configured to selectively vaporize a portion of the working fluid to pressurize the pressure chamber for ejecting ink drops through the nozzle.

2. The drop ejection system of claim 1, wherein a normal to the fluid interface is not parallel to a drop ejection direction.

3. The drop ejection system of claim 2, wherein the normal to the fluid interface is perpendicular to the drop ejection direction.

4. The drop ejection system of claim 1, wherein a direction of motion of the fluid interface is perpendicular to a drop ejection direction.

5. The drop ejection system of claim 4, the drop ejection system further comprising a transport mechanism for providing relative motion along a scan direction between a recording medium and a printhead containing the at least one drop ejection array module, wherein the direction of motion of the fluid interface is parallel to the scan direction.

6. The drop ejection system of claim 1, further comprising a stabilizing feature for stabilizing the fluid interface.

7. The drop ejection system of claim 6, wherein the stabilizing feature includes a structural feature disposed between the heating element and the nozzle.

8. The drop ejection system of claim 6, wherein the stabilizing feature includes a heat barrier disposed between the heating element and the nozzle.

9. The drop ejection system of claim 6, wherein the stabilizing feature includes:
- a first surface wetting characteristic of a first portion of the pressure chamber that is proximate to the heating element and distal to the nozzle; and
- a second surface wetting characteristic of a second portion of the pressure chamber that is proximate to the nozzle and distal to the heating element, wherein the second surface wetting characteristic is different from the first surface wetting characteristic.

10. The drop ejection system of claim 1, further comprising:
- a first valve disposed between the working fluid source and the working fluid inlet; and
- a second valve disposed between the ink source and the ink inlet.

11. The drop ejection system of claim 1, the working fluid source being a first working fluid source and the working fluid being a first working fluid, the drop ejection system further comprising a second working fluid source, wherein the second working fluid source contains a second working fluid that is immiscible with both the ink and the first working fluid.

12. The drop ejection system of claim 11, further comprising a third valve disposed between the second working fluid source and the ink inlet.

13. The drop ejection system of claim 1, wherein the at least one drop ejector array module includes a plurality of drop ejector array modules that are configured to extend a region over which ink can be ejected.

14. The drop ejection system of claim 13, wherein the plurality of drop ejector array modules are arranged end to end along an array direction.

15. The drop ejection system of claim 1, wherein the at least one drop ejector array includes:
- a first drop ejector array module for ejecting a first type of ink; and
- a second drop ejector array module for ejecting a second type of ink that is different from the first type of ink.

16. A method of operating an immiscible working fluid ink drop ejection system comprising:
- providing at least one drop ejector array module, each drop ejector array module including:
  - a substrate;

a nozzle plate;

an ink inlet;

a working fluid inlet;

an array of drop ejectors disposed on the substrate, each drop ejector including:

a nozzle disposed in the nozzle plate;

a pressure chamber in fluidic communication with the nozzle, the ink inlet, and the working fluid inlet, wherein the ink is in direct contact with the working fluid at a fluid interface, the pressure chamber including:

a top defined by the nozzle plate; and a bottom defined by the substrate, the bottom being opposite to the top; and a heating element disposed on the substrate within the pressure chamber;

pulsing the heating element to form a transient vapor bubble in the working fluid, thereby initiating a pressure wave;

transmitting the pressure wave to the ink in the pressure chamber, thereby moving the fluid interface along a first direction toward the nozzle; and ejecting at least one ink drop through the nozzle along a second direction that is different from the first direction.

17. The method of claim 16, wherein the second direction is perpendicular to the first direction.

18. The method of claim 16, further comprising:

allowing the transient vapor bubble to collapse; and repeating the pulsing and transmitting steps to eject additional drops of ink through the nozzle.

19. The method of claim 18, further comprising substantially stabilizing the fluid interface before repeating the pulsing and transmitting steps.

20. The method of claim 16, further comprising:

drawing working fluid out through the nozzle; and removing excess working fluid from an outer surface of the nozzle plate by wiping.

* * * * *